United States Patent [19]

Asano et al.

[11] 3,978,803

[45] Sept. 7, 1976

[54] CONTAINER OR CAN AND A METHOD FOR MANUFACTURING THE SAME

[75] Inventors: Hidejiro Asano; Yashichi Oyagi, both of Kitakyushu, Japan

[73] Assignee: Nippon Steel Corporation, Tokyo, Japan

[22] Filed: July 15, 1974

[21] Appl. No.: 488,576

[52] U.S. Cl. ..... 113/120 A; 29/195; 29/196.3; 29/196.6; 72/47; 204/25; 220/64; 427/239; 427/250; 427/405; 427/409

[51] Int. Cl.[2] ..... B21D 51/16

[58] Field of Search ..... 113/120 A; 72/46, 47, 72/347–349; 29/195, 196.3, 196.4, 196.6, 194; 220/64; 427/230, 234, 239, 405, 402, 409, 250, 258, 328; 204/14 R, 14 S, 23, 25, 26, 38 R, 38 A, 38 B, 38 S, 38 C, 38 E, 40, 49, 52 R, 54 R, 56 R

[56] References Cited

UNITED STATES PATENTS

| | | | |
|---|---|---|---|
| 3,077,421 | 2/1963 | Budininkas | 220/64 X |
| 3,360,157 | 12/1967 | Bolt et al. | 113/120 A X |
| 3,498,823 | 3/1970 | Jones et al. | 427/40 S |
| 3,760,751 | 9/1973 | Dunn et al. | 113/120 A X |
| 3,815,535 | 6/1974 | Becker et al. | 113/120 A |
| 3,820,368 | 6/1974 | Fukuzuka et al. | 113/120 A X |

*Primary Examiner*—Victor A. DiPalma
*Attorney, Agent, or Firm*—Watson Leavenworth Kelton & Tagga

[57] ABSTRACT

A steel sheet having a Ni or Cu base plating layer and a Sn upper plating layer characterized by the absence of any alloy layer intervening therebetween is subjected to an ironing operation with the thickness of the plating being relatively small. The internal surface of the can thus formed is provided with an organic coating for packing foodstuffs including effervescent beverages.

2 Claims, 2 Drawing Figures

LIFE OF CAN WITH EFFERVESCENT BEVERAGE OF LEMON-LIME SYSTEM

LIFE OF CAN WITH EFFERVESCENT BEVERAGE OF COCA-COLA SYSTEM

CONTAINER OR CAN AND A METHOD FOR MANUFACTURING THE SAME

DISCLOSURE OF INVENTION

This invention relates to a container or can adapted for use in packing foodstuffs.

More particularly, it relates to such a container or can having an internal surface coated and displaying an excellent anti-corrosive property. It also relates to a method for manufacturing the same.

As is well known, materials for container, or cans for packing foodstuffs have been developed to an extent wherein various materials such as iron, aluminum, plastics, paper, etc. have been used depending upon particular requirements and economies. In the field of the container or can, hereinafter referred to just as "can", used particularly for the effervescent beverages such as beer or refreshing drinks, the "two-piece" can has recently been used, of which the body and the bottom are shaped integrally by means of a combination work of drawing and ironing. "Ironing" means that a cup first made by drawing a sheet with a suitable set of punch and die, thereafter is again subjected to shaping by the use of a punch and die set having a clearance smaller than the thickness of the side wall of said cup, so that the side wall of said cup is stretched and made thinner whereby a deeper cup is obtained.

In the conventional practice for promoting the anti-corrosive property of the tin plate, it has been known that Ni-plating is effected first to the basic surface, upon which the tin-plating is then effected so that a dense alloy layer can be formed in the step for reflow or in the step for allowing Sn to melt out. Generally, this practice is effected when it is desired to pack acidic foodstuffs as represented by white peach or orange, etc. whereby the internal surface of the can is not subjected to the organic coating. As a result, the anti-corrosive property of the can or the life of the can depends much upon the density and stability of the Sn-Fe alloy layer as well as upon the thickness of the pure Sn layer.

However, in an attempt to form a can by means of ironing, this practice is quite useless, because the hard and brittle alloy layer will be so easily destroyed during the ironing step that the plating layer becomes discontinuous with a result of many cracks being caused therein after the ironing work. This effect becomes greater as the alloy layer exists nearer the surface. Therefore, the alloying of Sn with other plating metal should be avoided as much as possible for the ironing work. The can formed by ironing is usually used after it is subjected to coating with the organic film, whereby the above-mentioned defect part in the plating layer is readily corroded by the content foodstuffs, which results in a can with holes.

The inventors have made various studies regarding the anti-corrosive property of the can subjected to ironing work and having an internal organic coating with various content foodstuffs. According to the result of their studies, the anti-corrosive property of the can having an internal organic coating depends largely upon the potential relation in the content foodstuff between the plating metal and the base iron. In case of tin plate, the tin plating acts, in some case, as a dummy anode toward the iron and in other case, as a dummy cathode toward the iron, depending upon the content foodstuff, with which the life of the can varies very much. As contrasted to the can having no internal coating, the can having an internal coating has often suffered from holes caused by corrosion in case that the tin plating acts as the dummy anode toward the iron, which gives serious problems. In order to overcome these disadvantages or to solve the problem of cracks in the plating layer caused by the ironing work and the problem of corrosion caused by such cracks in case of coating, various studies have been made by the inventors regarding the thickness of many metal platings. As a result of it has now been found that the above problems can be overcome by applying a Ni- or Cu-plating having a thickness of 0.005 to 1.0 $\mu$ upon the steel sheet and further applying thereupon a tin plating having the thickness of 0.1 to 2.0 $\mu$ and characterized by the absence of any alloy layer. Avoidance of formation of an alloy layer can be done, for example by omitting the step for reflow. The means to effect plating may be any suitable practice such as gas reduction process, electrical process or chemical process, etc. and the organic coating which may be applied to the internal surface of the can may be any organic paint film, etc. Thus, according to this invention there is provided a container or can made from a steel sheet material, said material having a Ni or Cu base plating layer and a Sn upper plating layer, and no substantial alloying layer existing therebetween, said Ni or Cu base plating layer of said material having the thickness of substantially 0.005 $\mu$ to 1.0 $\mu$ and said Sn plating layer of said material having the thickness of substantially 0.1 $\mu$ to 2.0 $\mu$. Also provided is a method for making a container or can made of a thin steel sheet having the Ni or Cu base plating layer of substantially 0.005 to 1.0 $\mu$ and the Sn upper plating layer of substantially 0.1 to 2.0 $\mu$ without any substantial alloy layer existing therebetween, which comprises subjecting said thin steel sheet to ironing thereby to form a cup-like product.

As far as such double layer plating is concerned, there has hithertofore been a case of Ni-Cu or Ni-Sn.

The thickness of these plating layers is, however, in the high order of several microns to several tens of microns, which is not suitable for a can to be subjected to ironing.

On the contrary, the can of this invention has a very thin plating layer and can be successfully used as a can to be subjected to the ironing with remarkable effects.

In the practice of this invention, tin plate having Ni or Cu plating layer as the base layer and Sn plating layer as the upper layer is subjected to ironing and then to an internal organic coating. Thus in the defect part of the coating, the Sn layer will first melt out as the dummy anode, whereby the Cu or Ni base layer displays its anti-corrosive property effectively.

Thus it can be said that in the internally coated can, the existence of the plating layer or film which acts as the cathode toward the iron has an effective influence upon the anti-corrosive property of the can. It has now been found that such a plating layer can be as thin as 0.005 to 1.0 $\mu$ as the base layer and 0.1 to 2.0 $\mu$ as the upper layer. The effect of the anti-corrosive activity is saturated over the range above the upper limit of the above thicknesses, which does not change even when the ironing work is effected. It will obviously give a great effect upon the productivity of the tin plate that the plating layer can be made as thin as above.

On the other hand, the existence of two plating layers, i.e., the upper Sn layer and the lower Ni or Cu layer, are required in the ironing work. In the ironing work, the friction between the punch and die and the cupping material is unavoidable. If a lubricant is then used, it will greatly affect the surface conditions after the ironing work. Moreover, in case of subjecting this hard material to the ironing work, the conventional lubricant is not sufficient to give the desired surface conditions, which will give rise to cause serious troubles such as scratching, scorching or other defects in the can-making steps. However, if the tin or Sn exists in the outermost surface as the plating metal as in this invention, this Sn layer acts as a kind of lubricant, which gives an ironing-shaped can having the quite desirable surface. The significance of the double or two-layer construction having the base Ni or Cu layer and the upper Sn layer lies in this point.

The material used in this invention may be a thin sheet steel manufactured by the usual thin-steel-sheet making step; on which the Ni or Cu is plated to the thickness of 0.005 to 1 $\mu$ by the gas reduction process, the chemical process or the electric plating process, followed by a diffusion treatment, if necessary. Thereafter, the tin plating is effected thereupon to the thickness of 0.1 to 2 $\mu$ by the electric plating process. In case of this tin plating, the Sn-melting treatment or reflow is not conducted, which is distinguished from the usual tin plate. Thus the tin plate of this invention gives the appearance of frosted tin plate.

This invention is further described with reference to the Example and the drawings.

EXAMPLE

Figure 1:
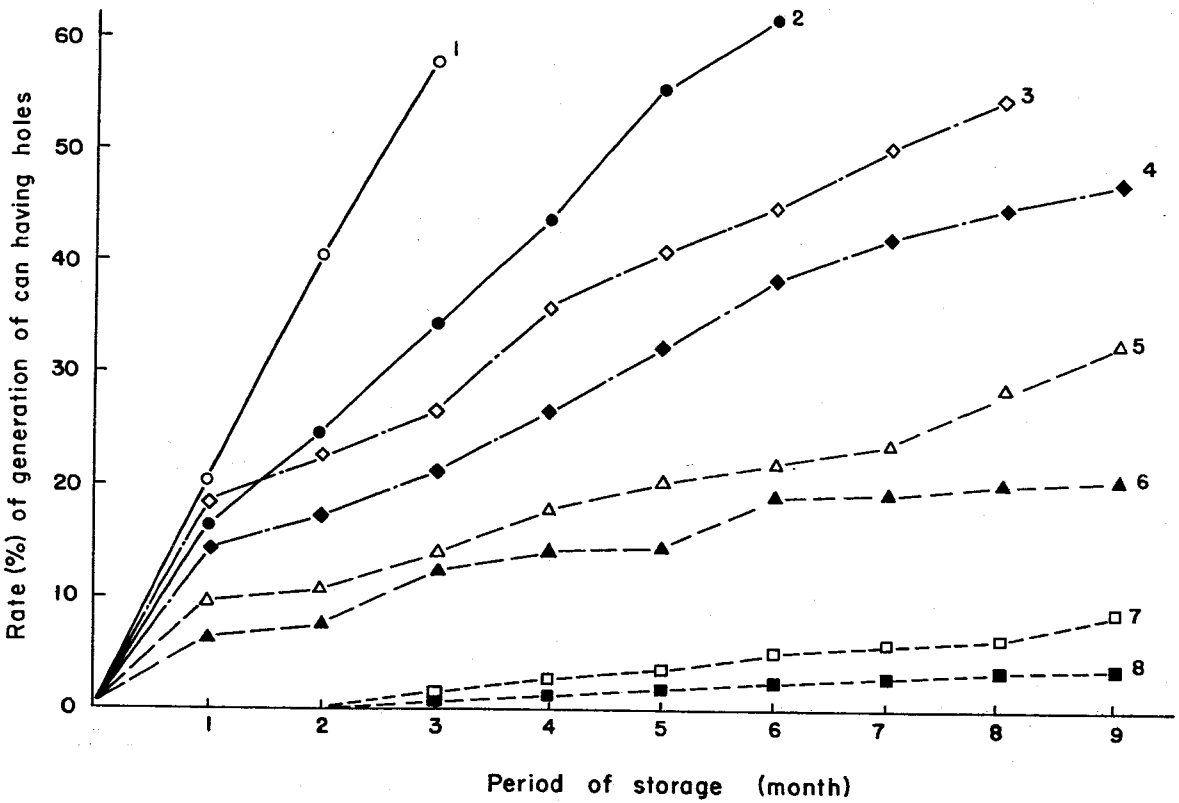
FIG. 1 is a graph illustrating the life of a can for the effervescent beverage of lemon-lime system.

A thin mild steel having the thickness of 0.34 mm was manufactured according to the usual process for making the thin steel sheet. Then the Ni plating was effected thereon as shown in Table 1 by the electric plating process. Thereafter, Sn plating as shown in Table 1 was further effected thereon.

Table 1

| | Thickness of Plating of Samples | | | | | | | |
|---|---|---|---|---|---|---|---|---|
| No. of Samples | 1 | 2 | 3 | 4 | 5 | 6 | 7 | 8 |
| Ni Plating thickness ($\mu$) | — | — | 0.01 | 0.01 | 0.11 | 0.11 | 0.98 | 0.98 |
| Sn Plating thickness ($\mu$) | 0.77 | 1.54 | 0.77 | 1.54 | 0.77 | 1.54 | 0.77 | 1.54 |

The above tin plates were subjected to the drawing and the ironing work to form cans having a thickness of the side wall of 0.10 mm. The cans thus formed were washed and subjected to the base treatment for coating by means of chemical treatment of a chromate system. Then they were subjected to spray coating with an thermosetting resin of epoxy-phenol system in an amount of 40 to 50 mg/dm$^2$ and thereafter packed with some typical commercial effervescent beverage. These cans were stored in a constant temperature chamber in which the temperature was controlled at 37°C and measured with respect to the period in which they were corroded to the extent of generation of holes.

Figure 2:
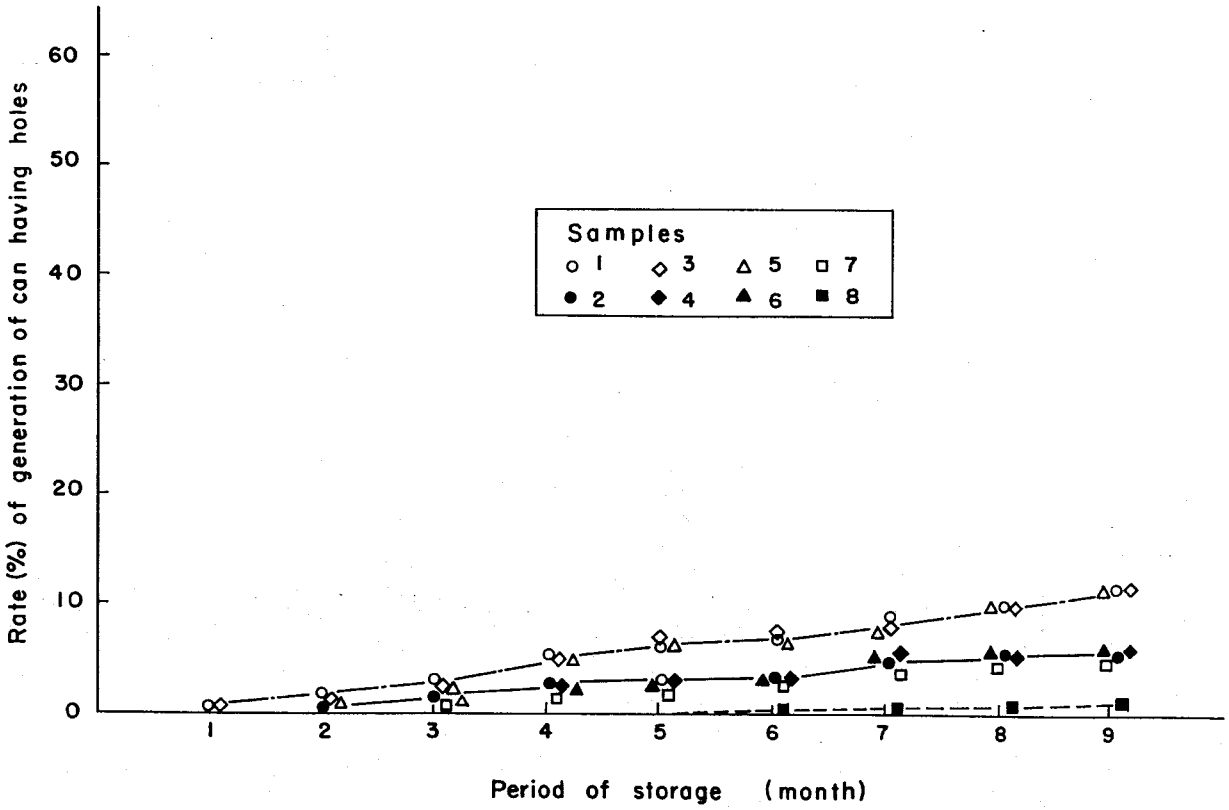
FIG. 2 is a graph illustrating the life of a can for the effervescent beverage of Coca-Cola system.

In FIGS. 1 and 2 is shown the change of rate of generation of the can having corrosion holes, in which the effervescent beverage of lemon-lime system is such Japanese goods as Kirin-lemon, Milinda-lemon, etc. and the beverage of Coca-Cola system is such goods as Coca-Cola, Pepsi-Cola, etc.

In FIG. 1, the axis of abscissa represents the storage period (unit: month) and the axis of ordinate represents the rate (%) of generation of the can having holes. Samples 1 and 2 are the conventional tin plate cans. Samples 3 to 8 are the cans according to this invention, in which it is seen that the effect is increased as the thickness of the Ni plating is increased from 0.01 $\mu$ to 0.98 $\mu$.

In FIG. 2, the axis of abscissa and the axis of ordinate show the same things as in FIG. 1, respectively. In this case it is seen that the thickness of platings (Sn + Ni) affects the anti-corrosion property of the cans.

It is thus seen that according to this invention a can subjected to ironing and having extremely excellent anti-corrosion property can and a method for making the same can be obtained.

We claim:

1. A method for making a container or can which comprises the steps of:

providing a steel sheet;

applying a base plating of one of Ni or Cu on said steel sheet to the thickness of substantially 0.005 $\mu$ to 1.0 $\mu$;

electrically plating a coating of Sn over said base plating to a thickness of substantially 0.1 $\mu$ to 2.0 $\mu$ without effecting reflow of the Sn and thereby providing for the absence of any alloy layer between said two platings;

subjecting said steel sheet to drawing and ironing operations to form a cup-like product; and applying an internal coating of an organic material to said cup-like product.

2. A method according to claim 1 in which the base plating is applied by one of a gas reduction process, an electric plating process or a chemical process, and optionally with a diffusion treatment.

* * * * *